US009293019B2

(12) United States Patent
Perreau et al.

(10) Patent No.: US 9,293,019 B2
(45) Date of Patent: Mar. 22, 2016

(54) APPARATUS AND METHOD FOR DETECTING A CLOSED CIRCUIT CONDITION IN A SECURITY DEVICE LANYARD

(71) Applicant: Checkpoint Systems, Inc., Thorofare, NJ (US)

(72) Inventors: Benoit Perreau, Weddington, NC (US); David P. Christianson, Charlotte, NC (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 316 days.

(21) Appl. No.: 13/834,606

(22) Filed: Mar. 15, 2013

(65) Prior Publication Data

US 2014/0266729 A1 Sep. 18, 2014

(51) Int. Cl.

| | |
|---|---|
| ***G08B 13/14*** | (2006.01) |
| ***G08B 13/24*** | (2006.01) |
| ***E05B 73/00*** | (2006.01) |
| ***E05B 45/00*** | (2006.01) |
| *G08B 1/00* | (2006.01) |
| *E05B 1/00* | (2006.01) |

(52) U.S. Cl.

CPC ..... *G08B 13/2434* (2013.01); *E05B 45/005* (2013.01); *E05B 73/0017* (2013.01); *E05B 73/0029* (2013.01); *E05B 1/00* (2013.01); *G08B 1/00* (2013.01)

(58) Field of Classification Search

CPC ..... G08B 1/00; E05B 1/00

See application file for complete search history.

(56) References Cited

U.S. PATENT DOCUMENTS

| | | | | |
|---|---|---|---|---|
| 2006/0170550 | A1* | 8/2006 | Marsilio et al. | 340/568.2 |
| 2010/0231388 | A1* | 9/2010 | Shute et al. | 340/568.4 |
| 2011/0260867 | A1* | 10/2011 | McCracken et al. | 340/568.4 |

* cited by examiner

*Primary Examiner* — Shirley Lu

(74) *Attorney, Agent, or Firm* — Nelson Mullins Riley & Scarborough LLP

(57) ABSTRACT

A security device may include a lanyard, a lanyard retention lock, and connectivity detection circuitry. The lanyard may include a first conductor and a second conductor that form an open circuit due to an insulator being electrically disposed therebetween. The lanyard retention lock may be configured to retain one or more ends of the lanyard to secure the security device to a protected object. The connectivity detection circuitry may be electrically connected to the first conductor and the second conductor. The connectivity detection circuitry may be configured to detect an occurrence of a closed circuit connection between the first conductor and the second conductor due to, for example, physical damage to the insulator, and may be configured to generate an alarm trigger signal in response to detecting the occurrence of the closed circuit connection between the first conductor and the second conductor.

13 Claims, 4 Drawing Sheets

APPARATUS AND METHOD FOR DETECTING A CLOSED CIRCUIT CONDITION IN A SECURITY DEVICE LANYARD

TECHNICAL FIELD

Example embodiments generally relate to security devices and, more particularly, relate to an apparatus and method for detecting a closed circuit condition in a security device lanyard.

BACKGROUND

Security devices have continued to evolve over time to improve the functional capabilities and reduce the cost of such devices. Some security devices are currently provided to be attached to individual products or objects in order to deter or prevent theft of such products or objects. In some cases, the security devices include tags or other such components that can be detected by gate devices at the exit of a retail establishment. When the security device passes through or proximate to the gates, an alarm locally at the product and/or at the gates may be triggered. A key may also be provided at the point of sale terminal so that the security device can be removed when the corresponding products or objects are purchased.

In order to avoid detection at these security gates, and enable removal of products from the store without purchase, some individuals may attempt to remove, tamper with, or destroy the security devices. Retailers have therefore demanded that the security devices be difficult to remove, disable, or destroy without detection. Thus, the security devices themselves may sometimes be secured or otherwise constructed so that they cannot be removed or disabled without either damaging the products being monitored or providing an indication to retailer employees.

In some cases, security devices may be attachable to a product via a lanyard and a lock, where the lanyard is held in locked engagement with or around a portion of the product. Removal of the lanyard may only be accomplished by damaging the product or the lock, or by cutting the lanyard. A common monitoring method for such a security device has been to pass a current through the lanyard and, if the current is interrupted, an alarm is sounded. Damage to the lock or lanyard may therefore cause an alarm to be triggered, which may deter such activity. However, the continuous provision of a monitoring current requires that battery power is also continuously consumed. Thus, the shelf life of such a monitoring system may be limited.

BRIEF SUMMARY OF SOME EXAMPLES

Accordingly, some example embodiments are provided to enable various provisions including, but not limited to, the provision of a longer-lived monitoring capability in security devices. In this regard, for example, some embodiments may provide a detection circuit that is configured to normally present an open circuit, rather than a normally closed circuit. Thus, rather than providing a detection circuit that is continuously consuming power by passing a current through a lanyard, some example embodiments may provide a detection circuit that reduces or eliminates the consumption of power, relative to comparable devices, so that the operating lire of the security device may be prolonged.

In one example embodiment, an apparatus, such as a security device is provided. The security device may include a lanyard in the form of, for example, a cable. The security device may also include a lanyard retention lock and connectivity detection circuitry. The lanyard may include a first conductor and a second conductor that form an open circuit due to an insulator electrically disposed therebetween. The lanyard retention lock may be configured to retain one or more ends of the lanyard to secure the security device to a protected object. The connectivity detection circuitry may be electrically connected to the first conductor and the second conductor. The connectivity detection circuitry may be configured to detect an occurrence of a closed circuit connection between the first conductor and the second conductor due to physical damage to the insulator, and may be configured to generate an alarm trigger signal in response to detecting the occurrence of the closed circuit connection between the first conductor and the second conductor.

In another example embodiment, connectivity detection circuitry is provided. The connectivity detection circuitry may be for an apparatus such as a security device having a lanyard that is attachable to a protected object. The connectivity detection circuitry may include a first conductor extending substantially along a length of the lanyard and a second conductor extending substantially along the length of the lanyard proximate to the first conductor and separated therefrom by an insulator electrically disposed between the first conductor and the second conductor. The connectivity detection circuitry may further include a power source configured to apply a potential to the first conductor, and a current detector disposed to detect an occurrence of a closed circuit connection between the first conductor and the second conductor due to physical damage to the insulator. The current detector may be configured to generate an alarm trigger signal in response to detecting the occurrence of the closed circuit connection between the first conductor and the second conductor.

BRIEF DESCRIPTION OF THE SEVERAL VIEWS OF THE DRAWING(S)

Having thus described some example embodiments of the invention in general terms, reference will now be made to the accompanying drawings, which are not necessarily drawn to scale, and wherein:

DETAILED DESCRIPTION

Figure 1A:
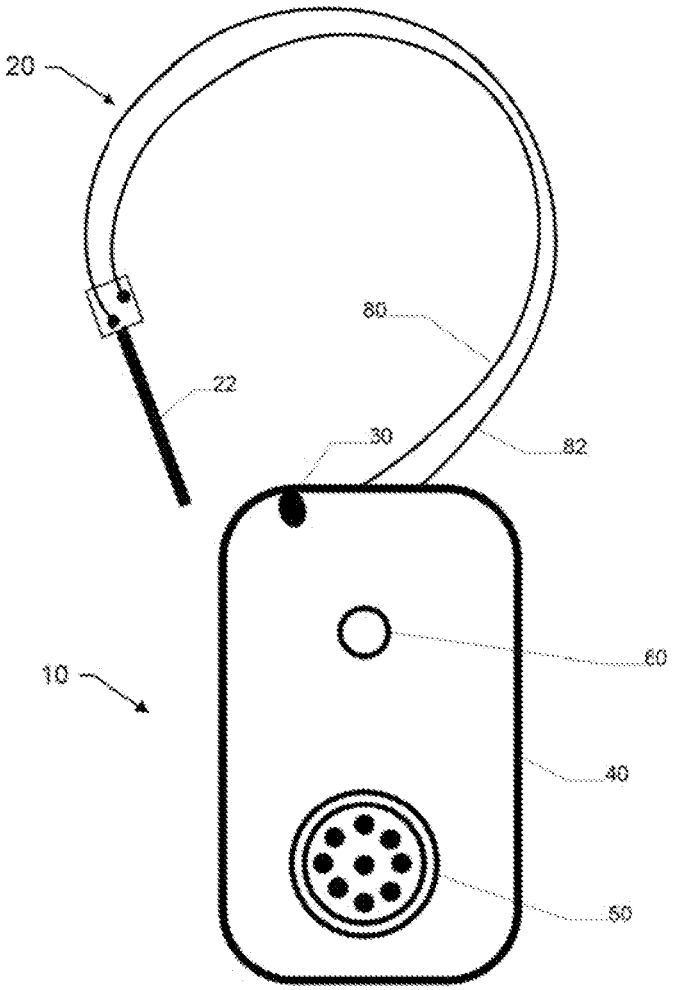
FIG. 1A is a front view of a security device according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability, or configuration of the present disclosure. Like reference numerals refer to like elements throughout. Furthermore, as used herein, the term "or" is to be interpreted as a logical operator that results in true whenever one or more of its operands are true. As used herein, operable coupling between components should be understood to relate to direct or indirect connection between the components that, in either case, enables at least a functional interconnection between the components. As used herein, the term circuitry is used to refer to electronic and electrical components structurally configured through the physical configuration of the components or the execution of software code by the components to perform a given function. The electronic and electrical components may include, but are not limited to, integrated circuits, processors, comparators, logic gates, transistors, capacitors, inductors, resistors.

Some example embodiments may include a relatively simple structure to provide long-lasting monitoring capability for security devices. In this regard, for example, some embodiments may provide a lanyard monitoring system that utilizes closed circuit detection circuitry. When a lanyard, for example in the form of a dual conductor cable, is damaged (e.g., cut), an insulator separating the two conductors within the lanyard may be physically damaged to enable an open circuit state between the conductors to transition to a closed circuit state to thereby, for example, cause an alarm to be triggered. Given that the conductors of the lanyard are maintained in an open circuit state or condition, current flow and power consumption can generally be reduced so that the shelf life of the security device can be increased. Moreover, in some cases, the technique of detecting a closed circuit connection between the conductors of the lanyard via the detection circuitry may be implemented in an inexpensive manner, resulting in cost reductions while still providing desirable functionality.

Various example embodiments are described herein that relate to a security device that is designed to provide an indication of a closed circuit connection between the conductors of a security device lanyard due to, for example, damage or destruction of a lanyard that attaches the security device to an object (e.g., a retail product, or other consumer good) using a closed circuit detection circuit. In this regard, FIG. 1A is a front view of a security device according to an example embodiment that illustrates a conceptual view of conductors within a lanyard or lanyard cable of a security device 10. As shown in FIG. 1A, the security device 10 may include a lanyard 20 and a lanyard retention lock entry opening 30 that may be disposed at a portion of a housing 40 of the security device 10. The housing 40 may provide a fixed anchoring structure for one end of the lanyard 20 (i.e., a fixed end of the lanyard 20), and may also provide a releasable anchoring or lockable structure for the opposite end of the lanyard 20 (e.g., a releasable end 22 of the lanyard 20) via a lanyard retention lock of the security device 10. The housing 40 may be made of one or more pieces of plastic, metal, and/or composite material.

In some embodiments, the housing 40 may provide an enclosed structure to protect circuitry and/or components that may be used to facilitate functions of the security device 10. The circuitry and/or components may include a battery for internal power, and circuitry for controlling operation and/or alarm functionality of the security device 10 as described in greater detail below. In some cases, the housing 40 may also house one or more security elements (e.g., radio frequency resonators, acousto-magnetic resonators, radio frequency antennas for use with, for example, and RFID chip) that may be configured to detect a security gate, or be detected by the security gate. Accordingly, for example, the security device 10 may be enabled to initiate (directly or indirectly, and locally or remotely) an alarm condition if the security device 10 is passed through the security gate prior to being removed from an object to which the security device 10 is secured via the lanyard 20 and the lanyard retention lock.

In an example embodiment, the housing 40 may include a sound generator 50 (e.g., a speaker, a piezo, or the like) that may be configured to provide an audible sound (e.g., tone or series of tones) when detection circuitry of the security device 10 provides an alarm trigger signal to cause production of the sound. Alternatively or additionally, the housing 40 may include one or more visual indicators 60, which may include a light or series of lights (e.g., light emitting diodes) that may be configured to provide a visual indication (e.g., flashing or continuous lighting) in response to direction from the detection circuitry of the security device 10 to provide an output. In some embodiments, the housing 40 may additionally or alternatively house a tactile generator that is configured to produce vibration in response to direction from the detection circuitry of the security device 10 to provide an output.

In an example embodiment, the releasable end 22 of the lanyard 20 may be configured to be lockable within the lanyard retention lock via the lanyard retention lock entry opening 30. Accordingly, for example, the releasable end 22 may be configured to be received within the lanyard retention lock, and may include one or more physical features (e.g., detents, protrusions, orifices, ridges, and/or the like) that may engage a locking mechanism within the lanyard retention lock 30. The locking mechanism may be enabled to be engaged or released to securely hold the one or more physical features of the releasable end 22 responsive to insertion of the releasable end 22 into the lanyard retention lock 30 and/or in response to operation of a mechanical, magnetic, or electronic key that may cause activation or release of the locking mechanism. In some example embodiments, the lanyard retention lock may include, for example, one or more leaf springs that can catch on a detent of the releasable end 22 to lock the releasable end 22 to the security device 10. The releasable end 22 may be released or unlocked in response to interaction with a magnetic field generated by, for example, a magnetic key pulls the leaf spring away from the releasable end 22 allowing the releasable end to be removed from the security device 10.

As shown in FIG. 1A, the lanyard 20 may include therein a first conductor 80 and a second conductor 82. The first and second conductors 80 and 82 may extend from the fixed end of the lanyard 20 to the releasable end 22 so that any damage or cutting along any exposed portion of the length of the lanyard 20 (i.e., any portion of the lanyard 20 that is not housed within the housing 40 or the lanyard retention lock when the releasable end 22 is locked within the lanyard retention lock) will necessarily impact a portion of the first conductor 80 and/or the second conductor 82. The first and second conductor 80 and 82 may be disposed within the lanyard 20 in such a way as to generally prevent electrical contact therebetween (e.g., via an insulator dispose between the conductors), except in the presence of some form of physical damage that is inflicted on the lanyard 20 as described in greater detail below.

Figure 1B:
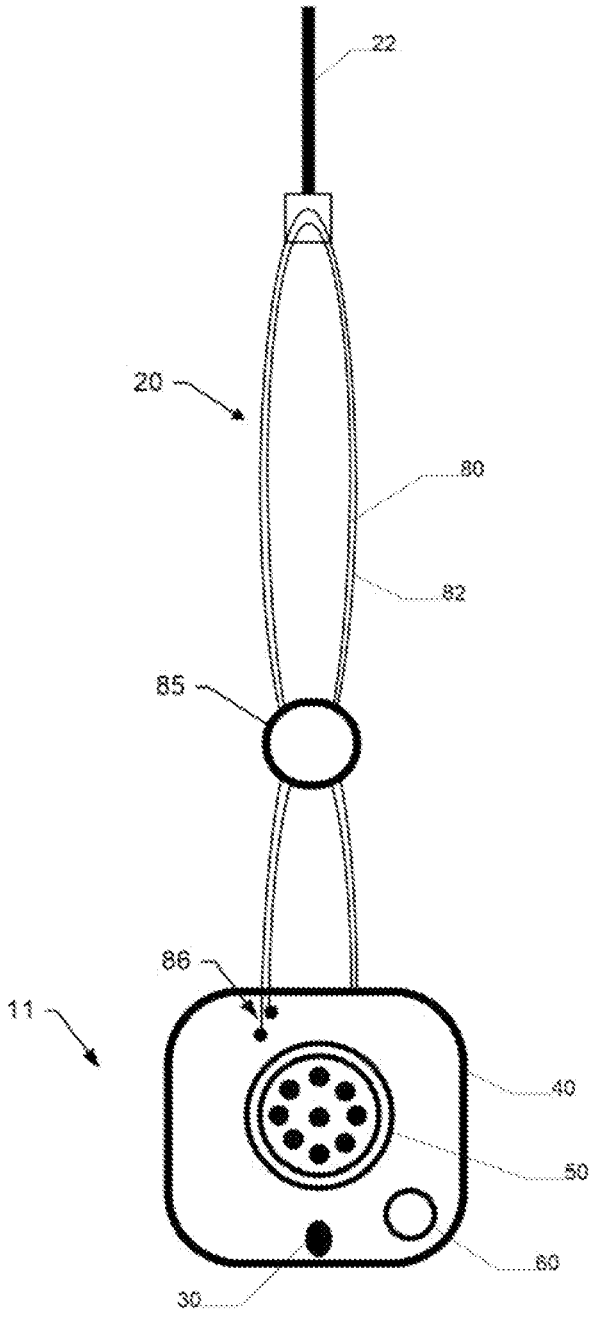
FIG. 1B is a front view of another security device according to an example embodiment.

It is noteworthy that the connectivity detection circuitry and related features described herein, are applicable to security devices that take a number of different forms, but utilize a sense loop for detecting tampering with the device. While FIG. 1A provides an illustration of an security device that may be referred to as a cable lock device, FIG. 1B provides another example security device that uses similar sense loop detection techniques in the form of a box wrap security device 11. Similar to the security device 10, the box wrap security device 11 includes a lanyard retention lock, a lanyard retention lock entry opening 30, a housing 40, a sound generator 50, and a visual indicator 60. The security device 11 also includes a lanyard 20 with conductors 80 and 82. However, in contrast to the lanyard of the security device 10, the lanyard 20 of the security device 11 may be fixedly attached to the security device 11 at both ends. As indicated at 86, the conductors 80 and 82 may remain in an open circuit configuration without an electrical connection between the two until damage to the lanyard 20 causes a closed circuit electrical connection between the conductors. The security device 11 may also include a spool and ratchet mechanism for extending or retracting the length of the lanyard 20. The lanyard 20 may pass through the medallion 85 to facilitate application of the device on, for example, a box. Further, the lanyard 20 may loop through the releasable end 22 of the lanyard 20 to allow movement of the releasable end 22 and adjustability to different sized boxes or the like. Accordingly, one of skill in the art will appreciate that the connectivity detection circuitry and other features describe herein can be applicable to a variety of security devices that utilize a sense loop for identifying tampering.

Figure 2:
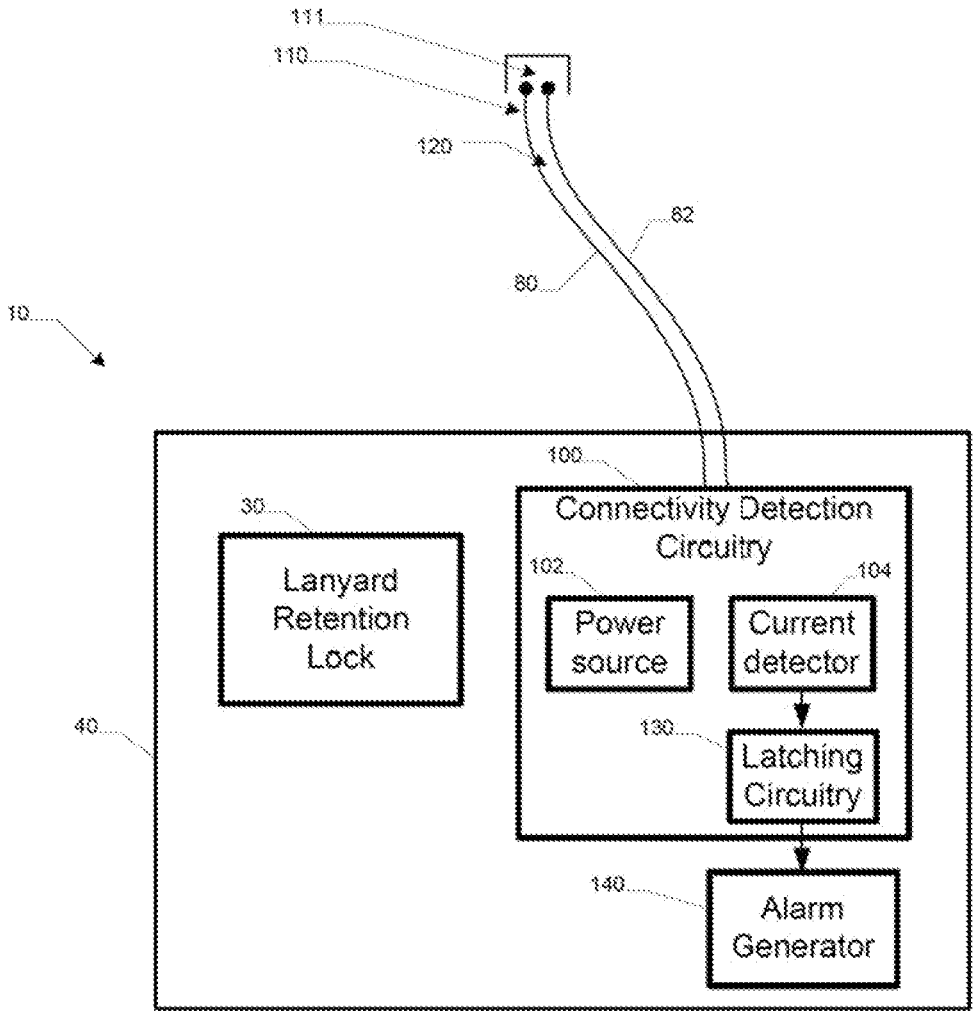
FIG. 2 is a functional block diagram of the security device according to an example embodiment.

FIG. 2 is a functional block diagram of an example security device according to various example embodiments. As shown in FIG. 2, the first and second conductors 80 and 82 may terminate electrically at connectivity detection circuitry 100 proximate to the fixed end of the lanyard 20. The first and second conductors 80 and 82 may then extend to open circuit end 111 where an open circuit 110 may be provided so that the first and second conductors 80 and 82 are otherwise not electrically connected to each other. As such, an insulator 120 may be provided between the first and second conductors 80 and 82 substantially along an entirety of the length of the first and second conductors 80 and 82. Furthermore, insertion of the releasable end 22 (whether disposed at an electrical end of the lanyard as provided in FIG. 1A or at a mid-span location on the lanyard as provided in FIG. 1B) into the lanyard retention lock may not impact the open circuit 110 condition of the first and second conductors 80 and 82. As such, the configuration of the electrical circuitry of the security device may be unchanged in response to the locking the lanyard or lanyard cable with the lanyard retention lock.

The connectivity detection circuitry 100 may be configured to normally experience an absence of current flow through the first and second conductors 80 and 82, but detect and/or indicate a fault or alarm condition in response to detection of a flow of current through the first and second conductors 80 and 82. In this regard, for example, the connectivity detection circuitry 100 may include a power source 102 (e.g., a battery) and a current detector 104 that may be configured to detect the flow of current through the first and second conductors 80 and 82. As such, for example, in a situation where the first conductor 80 is electrically connected to the second conductor 82, a current may flow from the power source 102 and through the first and second conductors 80 and 82 so that the current detector 104 detects such current flow. However, under normal circumstances, the first and second conductors 80 and 82 are electrically insulated from each other so that no current flows from the current detector, and the power source is either electrically isolated (e.g., if no other components are powered thereby) or is discharged at a lower rate (e.g., if the power source is used to power other components of the security device 10). In either case, since the load on the power source 102 is either reduced or eliminated, the power source 102 may experience a longer operational life than would be the case if the connectivity detection circuitry 100 was instead configured to normally detect current flow and indicate a fault responsive to interruption of the current flow. Accordingly, in some example embodiments, the current detection circuitry is configured to be in an unpowered state until a closed circuit connection between the first conductor and the second conductor occurs.

In an example embodiment, the connectivity detection circuitry 100 may be considered to include the first and second conductors 80 and 82. The connectivity detection circuitry 100 may also include and be operably coupled to latching circuitry 130 that may be configured to activate in response to a closed circuit detection signal generated by the current detector 104. Thus, for example, the connectivity detection circuitry 100 may be configured to generate the closed circuit detection signal in response to detection of current flow in the first and second conductors 80 and 82. According to some example embodiments, the closed circuit detection signal may be the present of current in a circuit that includes the conductors 80 and 82. The closed circuit detection signal may be the presence of current flow or a derivative of the current flow in the first and second conductors 80 and 82. However, in any case, it should be appreciated that the closed circuit detection signal may be generated based on an instantaneous detection of the current flow in the first and second conductors 80 and 82 (e.g., for a period of less than one second), or based on a continuous detection of the current flow (e.g., for a period of several seconds). In some embodiments, the closed circuit detection signal may only be generated for the period of time that current flow is detected in the first and second conductors 80 and 82 which may result from a temporary or a permanent closed circuit condition between the conductors. As such, the closed circuit detection signal may be generated as a single discrete pulse when generated. In still other examples, the closed circuit detection signal may be continuously applied until a reset is inserted or until other action is taken to secure provision of the closed circuit detection signal.

In some embodiments, the latching circuitry 130 may include simple circuitry (e.g., a flip-flop) that latches on or activates in response to the trigger signal, regardless of the duration of the closed circuit detection signal. The output of the latching circuitry may be referred to as an alarm trigger signal. As such, for example, if the closed circuit detection signal is received even for a relatively short period of time (e.g., less than one second), the latching circuitry 130 may switch on and provide a continuous alarm trigger signal to an alarm generator 140. Accordingly, for example, the latching circuitry 130 may be configured to receive the closed circuit detection signal for any duration of time (long or short), and provide a consistent output in the form the alarm trigger signal to the alarm generator 140 regardless of the length of time that the closed circuit detection signal input is provided. In some cases, the latching circuitry 130 may be set to output the alarm trigger signal as a particular value until a state change (e.g., an alarm turn off event) is experienced after the closed circuit detection signal is received. Then, responsive to receipt of the closed circuit detection signal, the alarm trigger signal provided by the latching circuitry 130 may change state and a different value may be output after the state change.

The alarm generator 140 may include or embody the speaker 50, the one or more visual indicators 60 (e.g., LED lights and/or the like) and/or any tactile generator to provide an alarm output based on the alarm trigger signal. In some embodiments, the latching circuitry 130 may include one or more flip flops, latches, switches, transistors, operational amplifiers, and/or other electrical components that may be triggered to change from an off state to an on state and then maintain the on state to apply an alarm condition by controlling the alarm generator 140 even after the input (e.g., the alarm trigger signal) is removed or is otherwise interrupted.

In some embodiments, the connectivity detection circuitry 100 including the latching circuitry 130 and/or the alarm generator 140 may include or otherwise be in communication with processing circuitry that is configurable to perform actions in accordance with example embodiments described herein. As such, for example, at least some of the functions attributable to the connectivity detection circuitry 100 and/or the alarm generator 140 may be carried out by or otherwise instructed (at least in part) by the processing circuitry. The processing circuitry may therefore provide the hardware for hosting software to configure the respective components for operating consistent with example embodiments. In some embodiments, the processing circuitry may be embodied as a chip or chip set. In other words, the processing circuitry may comprise one or more physical packages (e.g., chips) including materials, components and/or wires on a structural assembly (e.g., a baseboard). In an example embodiment, the processing circuitry may include one or more instances of a processor and memory that may be in communication with or otherwise control the respective components. As such, the processing circuitry may be embodied as a circuit chip (e.g., an integrated circuit chip) configured (e.g., with hardware, software or a combination of hardware and software) to perform operations described herein. However, in other embodiments, relatively simple gate logic and/or other electronic components may form the connectivity detection circuitry 100 and/or the alarm generator 140, so that no processor and/or memory is required to be employed.

Figure 3A:
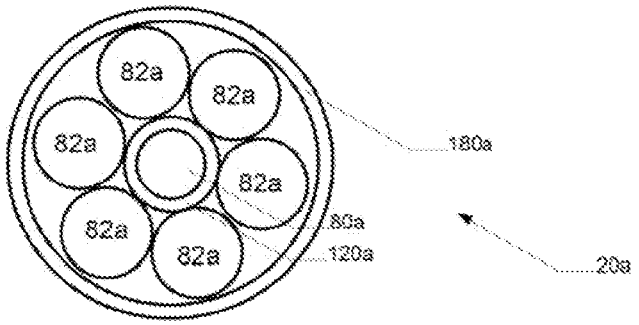
FIG. 3A illustrates a cross sectional view of conductors within the lanyard of a security device according to an example embodiment.
Figure 3B:
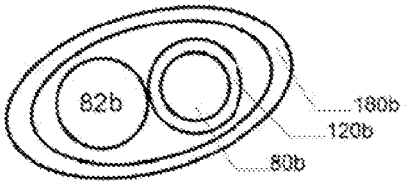
FIG. 3B illustrates a cross sectional view of an alternative arrangement of conductors within the lanyard of a security device according to an example embodiment.
Figure 3C:
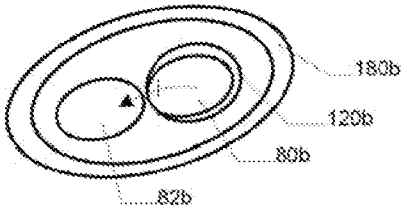
FIG. 3C illustrates the conductors of FIG. 3B forced into connection with each other responsive to damage to the insulator according to an example embodiment.
Figure 3D:
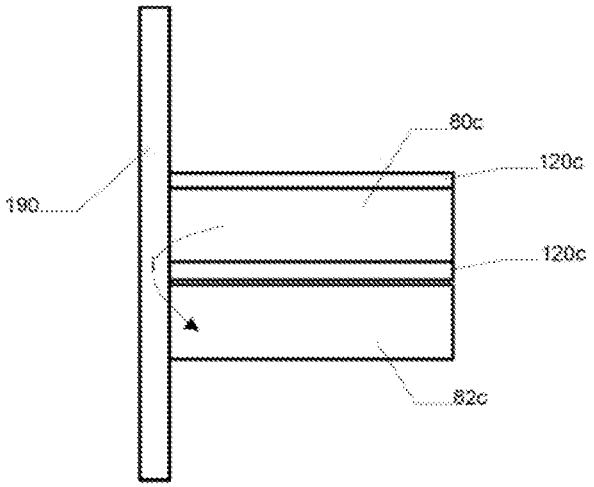
FIG. 3D illustrates a section view taken along a longitudinal length of conductors being cut by a tool within the lanyard of an example embodiment.

A discussion regarding the operation and structure of an example embodiment of the lanyard 20 and a lanyard cable will now be described with reference to FIGS. 3A, 3B, and 3C. FIG. 3A illustrates a cross sectional view of an example arrangement of conductors within a lanyard of a security device according to an example embodiment. FIG. 3B illustrates a cross sectional view of an alternative arrangement of conductors within the lanyard of a security device according to an example embodiment. FIG. 3C illustrates the conductors of FIG. 3B forced into connection with each other responsive to damage to the insulator according to an example embodiment. FIG. 3D illustrates a section view taken along a longitudinal length of conductors being cut by a tool within the lanyard of an example embodiment where the tool forms a third conductor that electrically connects the conductors of the lanyard. Referring now to FIGS. 3A, 3B, 3C, and 3D, various example structures of the first and second conductors 80 and 82, each of which is generally provided in the form of an elongated electrical conductor, are provided. The first conductors 80*a*, 80*b*, and 80*c* shown herein should be appreciated as examples of the first conductor 80, and the second conductors 82*a*, 82*b*, and 82*c* should also be appreciated as examples of the second conductor 82.

FIG. 3A illustrates an example lanyard 20*a* structure in which a first conductor 80*a* is surrounded around peripheral edges thereof by the insulator 120*a*. The insulator 120*a* may extend along an entirety of the length of the first conductor 80*a* and may substantially encase at least the radial edges of the first conductor 80*a*. A plurality of second conductors 82*a* may be distributed around the first conductor 80*a* and be separated therefrom by the insulator 120*a*. In some embodiments, the second conductors 82*a* may extend substantially parallel to the first conductor 80*a* over an entirety of the length of the first conductor 80*a*. In some example embodiments, second conductors 82*a* may form a tubular web around the insulator 120*a*. In some example embodiments, the second conductors 82*a* may be twisted or wrapped around the first conductor 80*a* as the second conductors 82*a* extend along the length of the first conductor 80*a*. Such twisting may add to the strength and flexibility of the lanyard 20*a*. However, in some cases additional cabling may be provided to extend along a length of the lanyard 20*a* to add, for example, strength. In any case, the lanyard 20*a* may have a casing 180*a* provided to enclose the first and second conductors 80*a* and 82*a* in the cable. The casing 180*a* may be a rigid or semi-rigid plastic, or any other suitable insulating material that may provide the aesthetic and functional characteristics that are desired for a given implementation. Although not required, and not shown in FIG. 3A, multiple instances of the first conductor 80*a* may be provided in some example embodiments. Moreover, in some cases, each of the second conductors 82*a* may also be encased in an insulating material.

In a situation in which the lanyard 20*a* is cut or otherwise significantly damaged, the insulator 120*a* may be damaged sufficiently to reduce or eliminate the effectiveness of the insulator 120*a* at keeping the first and second conductors 80*a* and 82*a* electrically separated from each other. Accordingly, for example, at least one of the second conductors 82*a* may contact the first conductor 80*a* so that a closed circuit is formed and current is enabled to flow through the conductors at the point where the insulator 120*a* damage has occurred to complete a circuit path. The connectivity detection circuitry 100 may then detect the current flow and issue the closed circuit detection signal. An alarm may then sound or be otherwise detectable as the alarm generator 140 is triggered by activation of the latching circuitry 130.

In some cases, an equal number of first conductors and second conductors may be provided. FIG. 3B illustrates an example in which a single first conductor 80*b* and a singe second conductor 82*b* are provided proximate to each other. The first and second conductors 80*b* and 82*b* may extend parallel to each other within the casing 180*b*, or may be twisted to extend in a somewhat helical pattern along respective lengths thereof. In any case, an insulator 120*b* may be disposed between the first and second conductors 80*b* and 82*b*. In some example embodiments, one or both of the first and second conductors 80*b* and 82*b* may have radial surfaces thereof coated by the insulator 120*b* to prevent the first and second conductors 80*b* and 82*b* from establishing a path for current flow that would be detectable by the connectivity detection circuitry 100.

As indicated above, cutting or otherwise damaging the lanyard 20*b* may cause the insulator 120*b* to be compromised. Compromising or destroying continuity of the insulator 120*b* may enable a current path (i) to be formed between the first conductor 80*b* and the second conductor 82*b* at a corresponding point along the length of the lanyard 20*b*. Accordingly, for example, second conductor 82*b* may be enabled to contact the first conductor 80*b* (as shown in FIG. 3C) so that a closed circuit is formed and current is enabled to flow through the first conductor 80*b* to the point where the insulator 120*b* damage has occurred and then complete a circuit path through the second conductor 82*b* so that the connectivity detection circuitry 100 can detect the current flow and issue the closed circuit detection signal, and in turn, an alarm trigger signal. An alarm may then sound or be otherwise detectable as the alarm generator 140 is triggered by activation of the latching circuitry 130.

In an example embodiment, the insulator 120 may not necessarily need to be destroyed or even compromised to the point that the first and second conductors 80 and 82 are enabled to physically contact each other. Instead, the insulator 120 may have an initial effective thickness that is sufficient to prevent the potential at, for example, the first conductor 80 from reaching and forming a circuit with the second conductor 82. Meanwhile, if the insulator 120 is damaged or deformed sufficiently to decrease the effective thickness of the insulator 120, it may reach a critical thickness that is insufficient to insulate and prevent a current path between the first and second conductors 80 and 82. Accordingly, responsive to damaging or cutting of the insulator 120, the effective thickness of the insulator 120 may be reduced to the point that the first and second conductors 80 and 82 are effectively able to form a closed circuit at the point of thickness reduction below a threshold amount.

In some embodiments, the first and second conductors 80 and 82 need not physically touch, and the insulator 120 may remain intact along all portions of the first and second conductors 80 and 82 except at the specific location at which a cutting tool is used to cut the lanyard 20. In such a scenario, current may be enabled to flow through the cutting tool (operating as a third conductor) to complete a closed circuit and allow current to flow through the first and second conductors 80 and 82. FIG. 3D illustrates a lanyard 20*c* having an insulator 120*c* that surrounds the first conductor 80*a*. As can be seen from FIG. 3D, the first and second conductors 80*c* and 82*c* need not physically contact each other. Instead, for the instant that the tool 190 is cutting through the first and second conductors 80*c* and 82*c*, a current path (i) from the first conductor 80*c* through the tool 190 and into the second conductor 82*c* is formed. The current path that is instantaneously formed may cause the connectivity detection circuitry 100, responsive to detection of the current flow, to issue the closed circuit detection signal to the latching circuitry 130. The latching circuitry 130 may then be activated and an alarm may then sound or be otherwise generated as the alarm generator 140 is triggered by activation of the latching circuitry 130.

Accordingly, an example embodiment may provide for an apparatus such as a security device that may include a lanyard or a lanyard cable, a lanyard retention lock and connectivity detection circuitry. The lanyard may include a first conductor and a second conductor that form an open circuit due to an insulator electrically disposed therebetween. The lanyard retention lock may be configured to retain one or more ends of the lanyard to secure the security device to a protected object. The connectivity detection circuitry may be electrically connected to the first conductor and the second conductor. The connectivity detection circuitry may be configured to detect an temporary or permanent occurrence of a closed circuit connection between the first conductor and the second conductor due to physical damage to the insulator, and may be configured to generate an alarm trigger signal in response to detecting the occurrence of the closed circuit connection between the first conductor and the second conductor.

In some embodiments, the security device may further include an alarm generator configured to activate in response to the alarm trigger signal to generate an audible tone, a visible output and/or a tactile output. Additionally or alternatively, according to some example embodiments, the connectivity detection circuitry is configured to be in an unpowered state until the closed circuit condition between the first conductor and the second conductor occurs. According to some example embodiments, the configuration of the electrical circuitry of the security device may be unchanged in response to locking the lanyard cable with the lanyard retention lock. In some cases, the connectivity detection circuitry may be electrically connected to the first and second conductors via a fixed end of the lanyard that is opposite to a releasable end of the lanyard. The releasable end of the lanyard may be lockable within the security device by the lanyard retention lock. In some embodiments, the connectivity detection circuitry may include latch circuitry configured to generate a continuous output in response to an instantaneous receipt of the closed circuit detection signal. In such an example, the closed circuit detection signal may be received for less than one second and an alarm is generated based on operation of the latch circuitry to produce the continuous output after removal of the closed circuit detection signal. In some embodiments, the connectivity detection circuitry may include latch circuitry configured to generate an alarm trigger signal as a continuous output in response to detecting the closed circuit connection between the first conductor and the second conductor even if the closed circuit connection between the first conductor and the second conductor is temporary. According to some example embodiments, the lanyard retention lock may be configured to unlock the lanyard in response to an interaction with a magnetic field. In some embodiments, the physical damage may be initiated by cutting of the lanyard such that at least a portion of the first conductor physically contacts a portion of the second conductor proximate to a portion of the insulator that is cut. In an example embodiment, a tool causing the physical damage may form a third conductor to cause the closed circuit connection between the first conductor and the second conductor. In some cases, the insulator may have a first thickness prior to the physical damage, and a second thickness after the physical damage. A potential between the first conductor and the second conductor may be insufficient to complete the closed circuit connection at the first thickness, but sufficient to complete the closed circuit connection at the second thickness. In some embodiments, radial edges of the first conductor may be covered by the insulator, for example, over substantially an entirety of a length of the first conductor. In an example embodiment, the second conductor may include a plurality of elongated conductor elements that substantially surround the first conductor. In some cases, the second conductor extends substantially parallel to the first conductor over an entirety of respective lengths of the first and second conductors, but in other cases the second conductor may be twisted around the first conductor over an entirety of respective lengths of the first and second conductors.

Example embodiments may provide a security device that can effectively protect a product to which it is attached from theft for a longer period of time by extending life of the power source due to the normally open condition that exists between the first and second conductors. Moreover, the simple detection circuit design may enable less complication and fewer parts to be employed in an effective and long lasting theft deterrent device. Many modifications and other embodiments of the inventions set forth herein will come to mind to one skilled in the art to which these embodiments pertain having the benefit of the teachings presented in the foregoing description and the associated drawings. Therefore, it is to be understood that the inventions are not to be limited to the specific embodiments disclosed and that modifications and other embodiments are intended to be included within the scope of the description. Moreover, although the foregoing description and the associated drawings describe exemplary embodiments in the context of certain exemplary combinations of elements and/or functions, it should be appreciated that different combinations of elements and/or functions may be provided by alternative embodiments without departing from the scope of the description. In this regard, for example, different combinations of elements and/or functions than those explicitly described above are also contemplated. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. An apparatus comprising:

a lanyard cable comprising a first conductor and a second conductor, wherein the first conductor and the second conductor form an open circuit due to an insulator electrically disposed between the first conductor and the second conductor;

a lanyard retention lock configured to retain an end of the lanyard cable to secure the apparatus to a protected object; and connectivity detection circuitry electrically connected to the first conductor and the second conductor, wherein the connectivity detection circuitry is configured to:

detect a temporary or permanent closed circuit connection between the first conductor and the second conductor due to physical damage to the insulator, wherein the insulator has a first thickness prior to the physical damage, and a second thickness after the physical damage, and wherein a potential between the first conductor and the second conductor is insufficient to complete the closed circuit connection responsive to the insulator having the first thickness, but sufficient to complete the closed circuit connection responsive to the insulator having the second thickness; and generate an alarm trigger signal in response to detecting the closed circuit connection between the first conductor and the second conductor.

2. The apparatus of claim 1, further comprising an alarm generator configured to receive the alarm trigger signal and activate one or more of an audible output, a visible output, or a tactile output in response to the alarm trigger signal.

3. The apparatus of claim 1, wherein the connectivity detection circuitry includes current detection circuitry that is configured to be in an unpowered state until the closed circuit connection between the first conductor and the second conductor occurs.

4. The apparatus of claim 1, wherein a configuration of the electrical circuitry of the apparatus is unchanged in response to locking the lanyard cable with the lanyard retention lock.

5. The apparatus of claim 1, wherein the connectivity detection circuitry is electrically connected to the first and second conductors via a fixed end of the lanyard that is opposite to a releasable end of the lanyard, the releasable end of the lanyard being lockable within the apparatus by the lanyard retention lock.

6. The apparatus of claim 1, wherein the connectivity detection circuitry includes latch circuitry configured to generate the alarm trigger signal as a continuous output in response to detecting the closed circuit connection between the first conductor and the second conductors even if the closed circuit connection between the first conductor and the second conductor is temporary.

7. The apparatus of claim 1, wherein the lanyard retention lock is configured to unlock the lanyard cable in response to an interaction with a magnetic field.

8. The apparatus of claim 1, wherein the physical damage is initiated by cutting of the lanyard cable such that at least a portion of the first conductor physically contacts a portion of the second conductor.

9. The apparatus of claim 1, wherein a tool causing the physical damage forms a third conductor to cause the closed circuit connection between the first conductor and the second conductor.

10. The apparatus of claim 1, wherein radial edges of the first conductor are covered by the insulator over an entirety of a length of the first conductor.

11. The apparatus of claim 1, wherein the second conductor comprises a plurality of elongated conductor elements that substantially surround the first conductor.

12. The apparatus of claim 1, wherein the second conductor extends substantially parallel to the first conductor over substantially an entirety of respective lengths of the first and second conductors.

13. The apparatus of claim 1, wherein the second conductor is twisted around the first conductor.

* * * * *